US005890523A

United States Patent [19]

Johnson

[11] Patent Number: 5,890,523

[45] Date of Patent: Apr. 6, 1999

[54] CURVED RAIL WITH TOOL SUPPORT TROLLEY FOR WORKSTATION

[75] Inventor: James W. Johnson, Hartford, Wis.

[73] Assignee: Hubbell Incorporated, Orange, Conn.

[21] Appl. No.: 856,821

[22] Filed: May 15, 1997

[51] Int. Cl.[6] ..... B25H 1/00

[52] U.S. Cl. ..... 144/286.5; 144/1.1; 144/134.1; 144/286.1; 408/234; 408/237; 248/651; 248/652; 81/57.4

[58] Field of Search ..... 144/1.1, 2.1, 134.1, 144/136.1, 286.1, 286.5, 371; 408/146, 186, 234, 237; 248/651, 652, 654; 104/106; 81/57.4, 57.24

[56] References Cited

U.S. PATENT DOCUMENTS

| | | | |
|---|---|---|---|
| D. 161,733 | 1/1951 | Burchard | D33/7 |
| D. 201,971 | 8/1965 | Mohon | D33/7 |
| D. 203,602 | 2/1966 | Dusman | D33/14 |
| D. 242,832 | 12/1976 | Swensson | D6/159 |
| D. 283,092 | 3/1986 | Johnston | D6/423 |
| D. 332,188 | 1/1993 | Brodbeck | D6/421 |
| 734,817 | 7/1903 | Cavanagh et al. . | |
| 2,725,619 | 12/1955 | Miller | 29/288 |
| 3,869,992 | 3/1975 | Kramer | 108/60 |
| 4,271,730 | 6/1981 | Höll et al. | 81/57.4 |
| 4,591,128 | 5/1986 | Karlichek et al. | 248/652 |
| 4,936,228 | 6/1990 | Capo-Bianco | 108/64 |
| 4,947,910 | 8/1990 | Reneau | 144/371 |
| 4,953,469 | 9/1990 | Kuchta et al. . | |
| 5,065,832 | 11/1991 | Mark | 108/60 |
| 5,273,090 | 12/1993 | Klemma | 144/286.5 |
| 5,303,755 | 4/1994 | Poling | 144/286.5 |
| 5,367,924 | 11/1994 | Henson et al. | 81/57.4 |
| 5,481,987 | 1/1996 | Maitland | 108/90 |
| 5,779,216 | 7/1998 | Grace et al. | 248/651 |

*Primary Examiner*—W. Donald Bray
*Attorney, Agent, or Firm*—Jerry M. Presson; David L. Tarnoff; Alfred N. Goodman

[57] ABSTRACT

A workstation is provided with a curved tool rail suspended above a work surface. The curved tool rail has a tool trolley slidably coupled thereto for movably supporting a tool or part above the work surface. In a preferred embodiment, the work surface is part of a work bench. Preferably, the curved tool rail is suspended above the work surface by an adjustable frame which provides four-way adjustability of the curved tool rail. The curved tool rail keeps the tool or part suspended therefrom in reach of the worker.

32 Claims, 6 Drawing Sheets

CURVED RAIL WITH TOOL SUPPORT TROLLEY FOR WORKSTATION

FIELD OF THE INVENTION

The present invention generally relates to a workstation having a work surface with a tool rail mounted above the work surface for movably positioning a tool suspended therefrom. More specifically, the present invention relates to a workstation which is ergonomically designed to suspend a tool on a trolley for movement along an arc such that the tool is always within reach of the worker.

BACKGROUND OF THE INVENTION

In many industries, workers periodically need to use one or more tools at their workstations. This need creates many special problems. For example, when the tool or tools are not being used by the worker, the tool or tools must be stored in a convenient location so that the worker can easily access the tool or tools when needed.

Moreover, often times, the tool can be quite heavy and/or difficult to handle. This can result in the worker becoming fatigued from handling the tool. Accordingly, many tools are supported by arms and/or cables such that the worker does not have to support the weight of the tool. However, these tool supports are often difficult to manipulate to a particular location.

Currently, workstations are known which have a bench with a straight tool rail attached thereto. An example of a bench with a straight tool rail is disclosed in U.S. Pat. No. 2,725,619 to Miller. While such a workstation performs certain operations satisfactorily, it does not support the part or tool in an optimized manner for the worker to reach the part or tool at any position along the rail. In particular, if the part or tool is located at one of the ends of the rail and the worker is located at the center of the bench, the worker may not be able to reach the part or tool without getting up or moving towards the part or tool.

In view of the above, it will be apparent to those skilled in the art from this disclosure that there exists a need for an improved workstation with a tool or part support which is ergonomically designed for the worker. This invention addresses this need in the art along with other needs which will become apparent to those skilled in the art once given this disclosure.

SUMMARY OF THE INVENTION

One object of the present invention is to provide a curved rail with a tool support trolley for a workstation such that the tool apart supported therefrom is easily reachable to the worker.

Another object of the present invention is to provide a tool-support assembly which can be retrofitted to existing benches and/or work surfaces.

Yet another object of the present invention is to provide an ergonomic workstation which utilizes a curved tool rail in accordance with the present invention.

Another object of the present invention is to provide a curved tool rail with a tool trolley which is vertically adjustable as well as adjustable in a forward and rearward direction.

The foregoing objects are basically attained by providing an ergonomic workstation, comprising a work surface with an upper surface for working thereon, a lower surface and a front edge which is accessible to a worker, a first support coupled to the work surface to maintain the work surface at a predetermined height; a curved tool rail having a first end and a second end with a tool trolley movably coupled thereto for movement along the tool rail between the first and second ends; and a second support coupled to the curved tool rail and positioned relative to the work surface to suspend the curved tool rail above the work surface.

The foregoing objects can also be attained by providing a tool support assembly for a workstation, comprising a curved tool rail having a first end and a second end with a tool trolley movably coupled thereto for movement along the tool rail between the first and second ends; a frame having a pair of horizontal support members coupled to the curved tool rail and a pair of vertical columns coupled to the support members, respectively to suspend the curved tool rail above a work area; and an attachment member coupled to the columns to vertically support the columns.

Other objects, advantages and salient features of the present invention will become apparent to those skilled in the art from the following detailed description, which, taken in conjunction with the annexed drawings discloses preferred embodiments of the present invention.

BRIEF DESCRIPTION OF THE DRAWINGS

Referring now to the attached drawings which form part of this original disclosure.

DETAILED DESCRIPTION OF THE PREFERRED EMBODIMENTS

Figure 1:
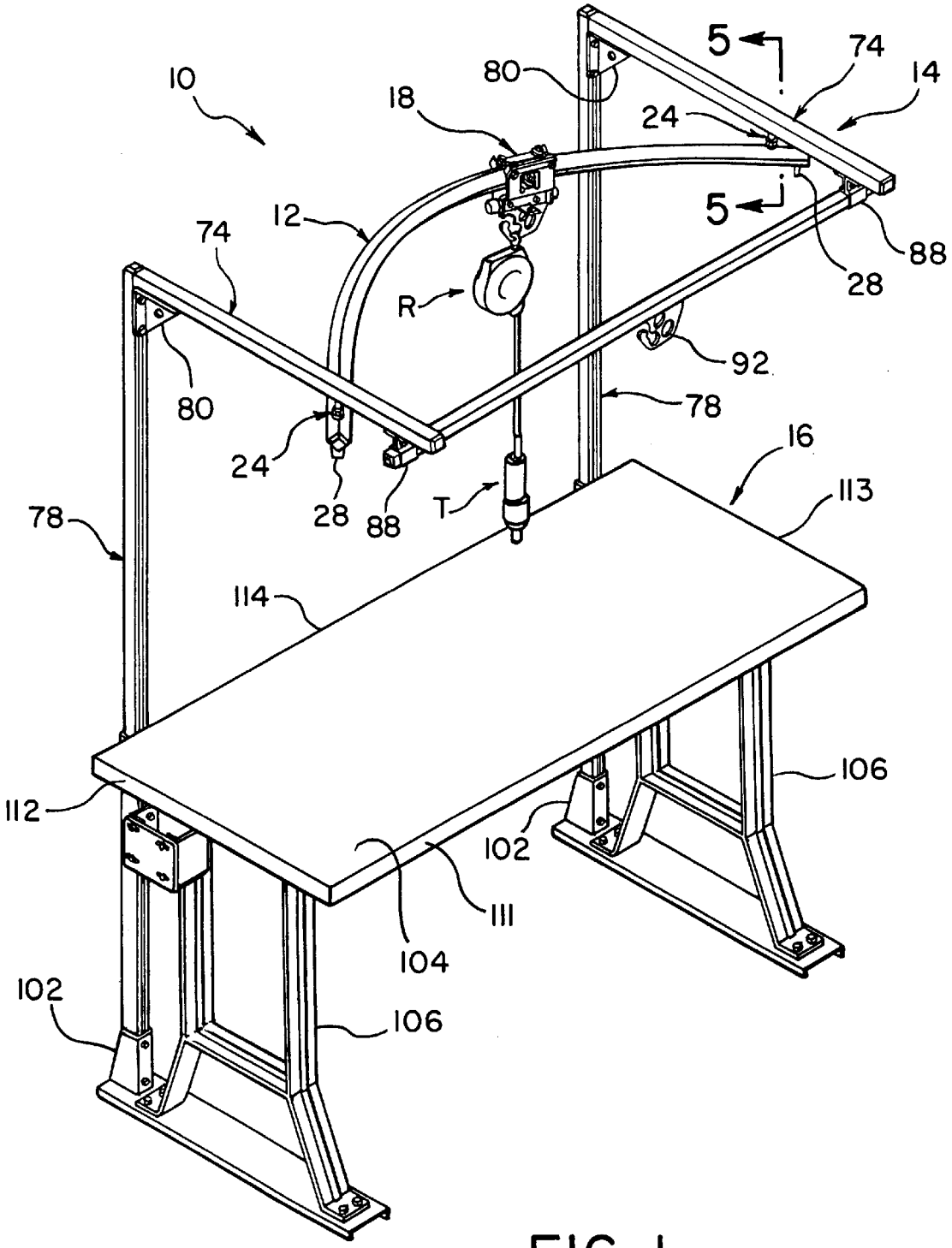
FIG. 1 is a perspective view of an ergonomic workstation in accordance with a first embodiment of the present invention in which a curved tool rail with a tool trolley is suspended above a work surface in accordance with the present invention.
Figure 2:
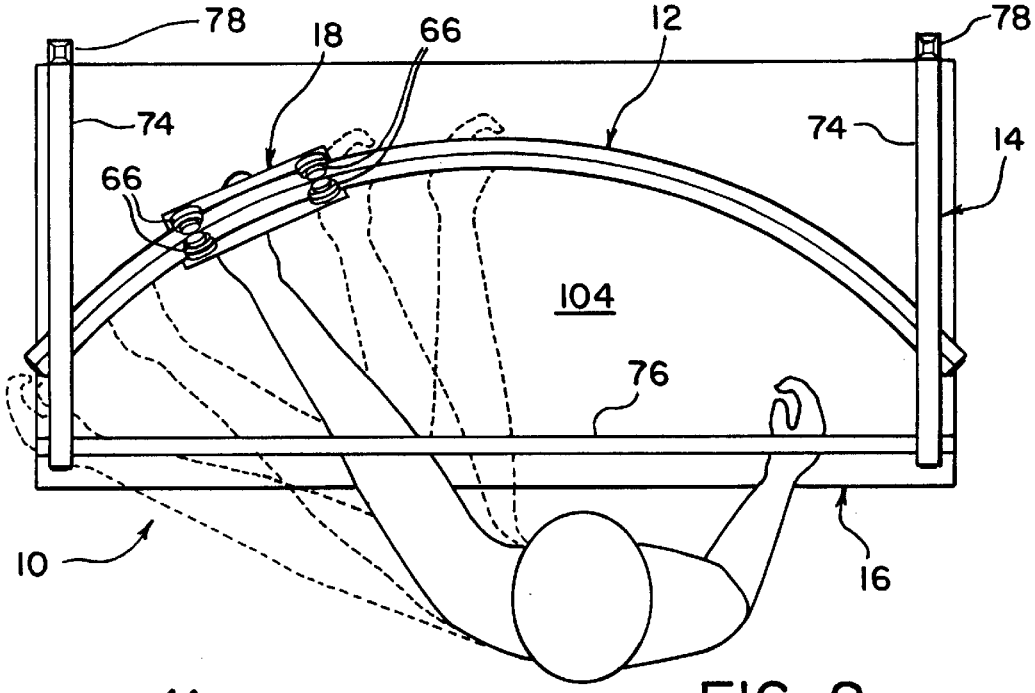
FIG. 2 is a top diagrammatic plan view of an ergonomic workstation illustrated in FIG. 1, with a person shown using the ergonomic workstation.

Referring initially to FIGS. 1 and 2, an ergonomic workstation 10 in accordance with the present invention is illustrated. Workstation 10 has a curved tool rail 12 supported by a tool support frame 14 above a work surface or bench 16. Curved tool rail 12 has a tool trolley 18 slidably coupled for movement therealong. The tool trolley 18 is designed to support a tool or part for movement along curved tool rail 12.

Attached to tool trolley 18 is a balance reel R with a tool T as seen in FIG. 1. Balance reels are well-known in the art, and thus, balance reel R will not be discussed or illustrated in detail herein. Balance reels for use with the present invention are sold by Gleason Reel Corp. Of course, it will be apparent to those skilled in the art from this disclosure that other types of support members could be attached to tool trolley 18 such as an articulating arm which may or may not use a balance reel.

Curved tool rail 12 allows the tool or part to be rolled within an arc which is substantially equal to the reach of the worker as seen in FIG. 2. As explained below, curved tool rail 12 is vertically adjustable as well as horizontally adjustable such that workstation 10 can be adjusted to meet a specific person's needs. In other words, workstation 10 is designed such that workstation 10 can conform to a specific person's size such that the tool or part supported on curved tool rail 12 is kept within the worker's reach. In particular, the worker can adjust curved tool rail 12 of workstation 10 such that the tool trolley 18 moves along a curved path which lies along the movement of the person's or worker's arm as seen in FIG. 2. For example, workstation 10 is preferably adjusted such that if the worker extends his or her arm and moves it from side to side, the path of the worker's hand forms an arc which is substantially equivalent to the movement of tool trolley 18 along curved tool rail 12.

Figure 3:
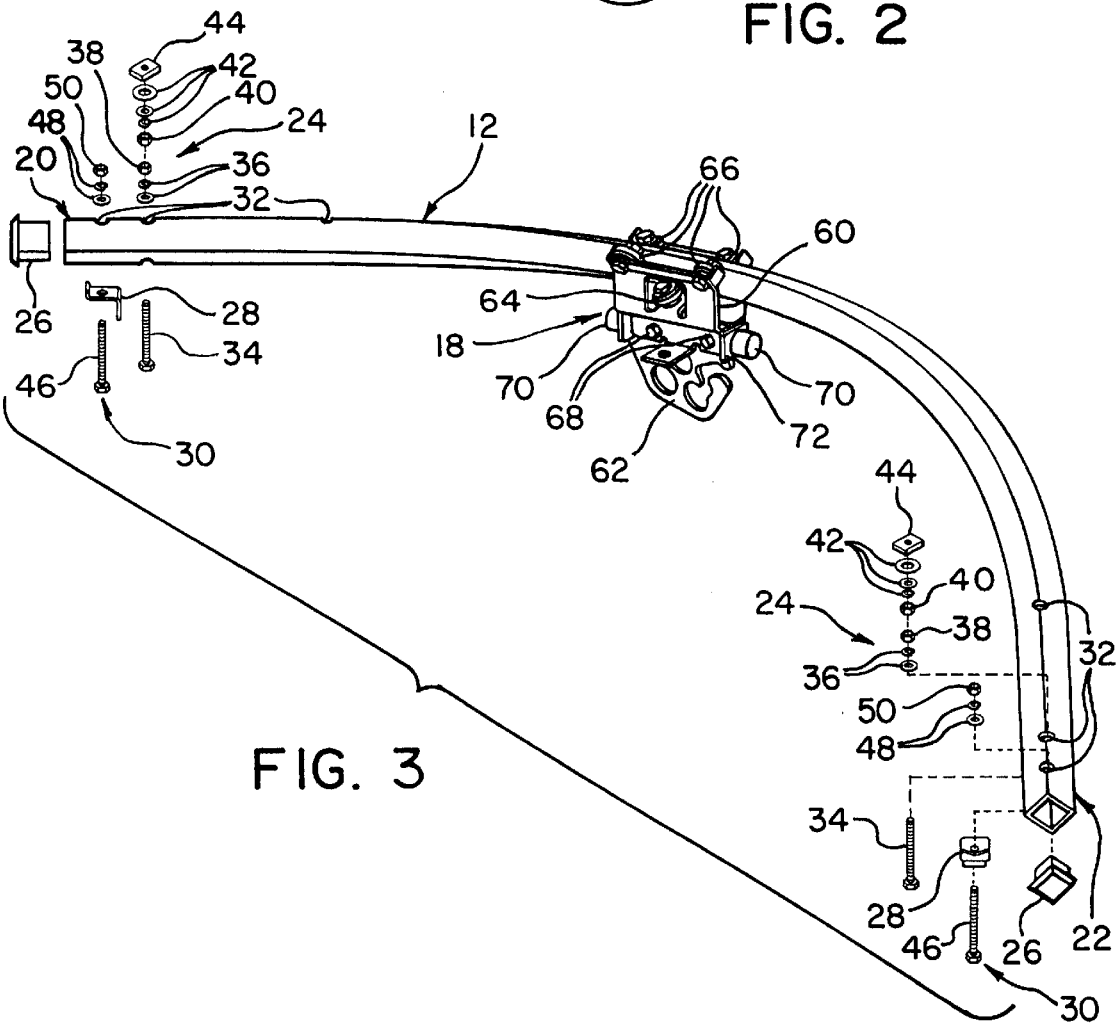
FIG. 3 is an enlarged, partially exploded perspective view of the curved tool rail with the tool trolley attached thereto in accordance with the present invention.

Referring now to FIG. 3, curved tool rail 12 is preferably a hollow tube having a substantially square cross-section with one of the diagonals of the square cross-section being vertically arranged. Curved tool rail 12 is constructed from a rigid material such as metal. For example, curved tool rail 12 can be constructed of a light-weight metallic material such as aluminum. Preferably, the radius of curvature of curved tool rail 12 is in the range of approximately 2.5 to approximately 3.5 feet. The preferred radius of curvature of curved tool rail 12 is approximately 3.0 feet. Curved tool rail 12 has a first end 20 and a second end 22 which are adjustably coupled to tool support frame 14 by fasteners 24 as discussed below.

Preferably, first and second ends 20 and 22 are also provided with end caps 26 for closing off the open end of curved tool rail 12. End caps 26 are preferably frictionally retained within the open ends 20 and 22 of curved tool rail 12. End caps 26 can be a molded member constructed of a plastic material such as vinyl.

Figure 9:
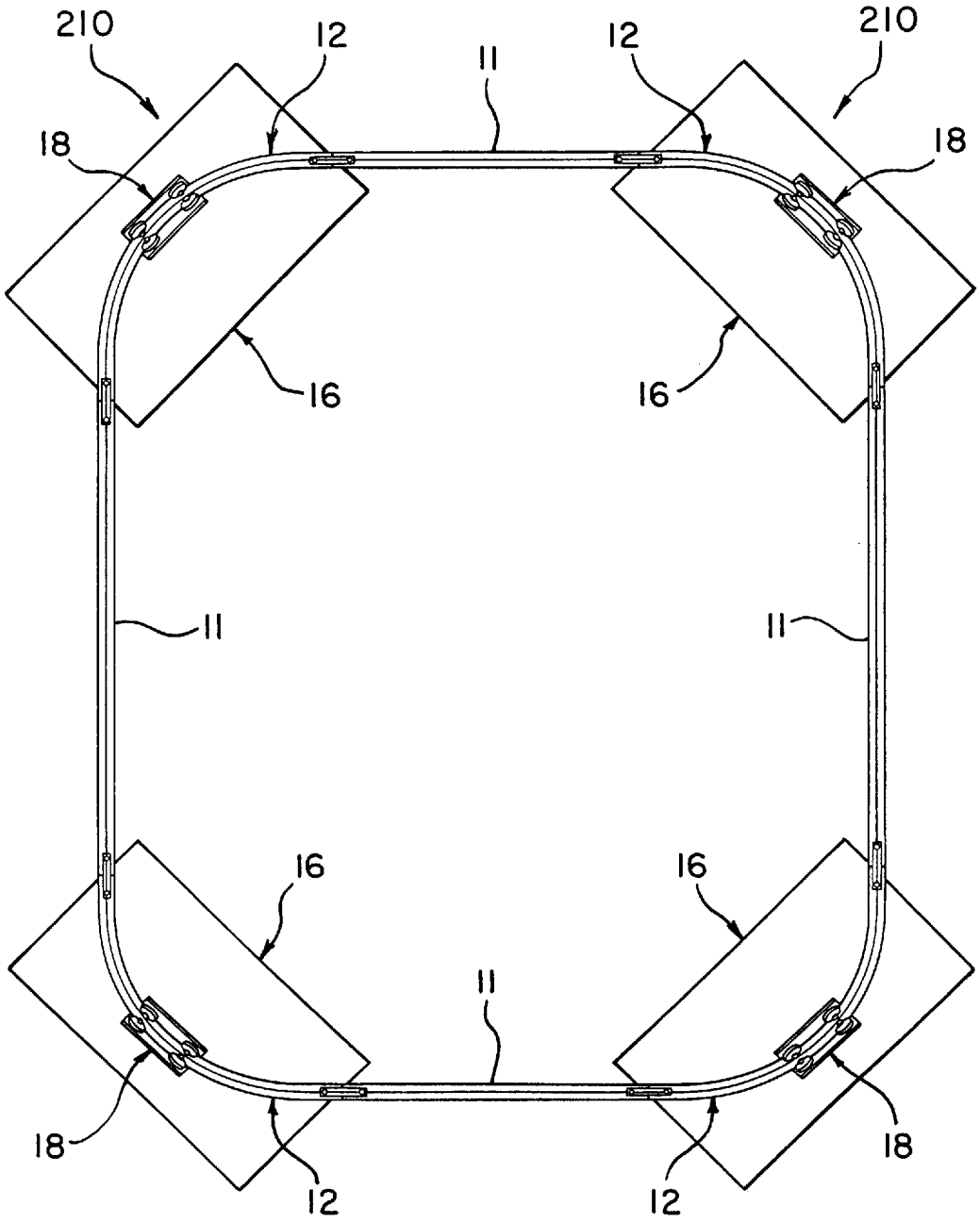
FIG. 9 is a top diagrammatic plan view of a plurality of workstations in accordance with a fourth embodiment of the present invention, in which the curved tool rails of each of the workstations are coupled together via straight tool rails.

Stops 28 are also coupled to the first and second ends of curved tool rail 12 for limiting the sliding movement of tool trolley 18 along curved tool rail 12. In particular, stops 28 prevent tool trolley 18 from being inadvertently disengaged from curved tool rail 12. Of course, it will be apparent to those skilled in the art from this disclosure that end caps 26 and stops 28 can be removed if curved tool rail 12 is interconnected with another tool rail as part of a tool rail assembly as seen in FIG. 9. Stops 28 are adjustably coupled to curved tool rail 12 as discussed below. Preferably, stops 28 are constructed of a rigid metallic material such as zinc plated steel.

Each of the first and second ends 20 and 22 of curved tool rail 12 has three holes 32 extending vertically therethrough such that curved tool rail 12 can be coupled at various locations to tool support frame 14 via fasteners 24. Preferably, each of the fasteners 24 includes a vertically extending bolt 34, a first set of washers 36, a first nut 38, a second nut 40, a second set of washers 42 and a nut plate 44. Fasteners 24 are coupled to curved tool rail 12 by inserting bolts 34 upwardly through selected holes 32 such that the head of the bolts 34 engage the bottom corner of the curved tool rail 12 and the threaded section extends upwardly from curved tool rail 12. Next, the first set of washers 36 are placed over the threaded end of bolts 34, and then first nuts 38 are threaded onto the threaded ends of bolts 34 for securing bolts 34 to the first and second ends 20 and 22 of curved tool Tail 12.

Now, the curved tool rail 12 can be coupled to tool support frame 12 via second nuts 40, second sets of washers 42 and nut plates 44. First, nuts 40 are threaded onto the threaded end of bolts 34 for a predetermined distance. Next, washers 42 are inserted over the threaded end of bolts 34, and finally, bolts 34 are threaded into nut plates 44 which are located within the interior of tool support frame 14. Thus, a portion of tool support frame 14 is sandwiched between the second set of washers 42 and nut plates 44 to secure curved tool rail 12 to tool support frame 14 as discussed below.

Stops 28 can be coupled to curved tool rail 12 via fasteners 24 which are used to attach curved tool rail 12 to tool support frame 14 as discussed above, or via their own individual fasteners 30 as needed and/or desired. Fastener 30 is similar to fastener 24 in that it includes a bolt 46, a set of washers 48 and a nut 50. Stops 28 are attached to the first and second ends 20 and 22 of curved tool rail 12 via one of the sets of holes 32.

Figure 5:
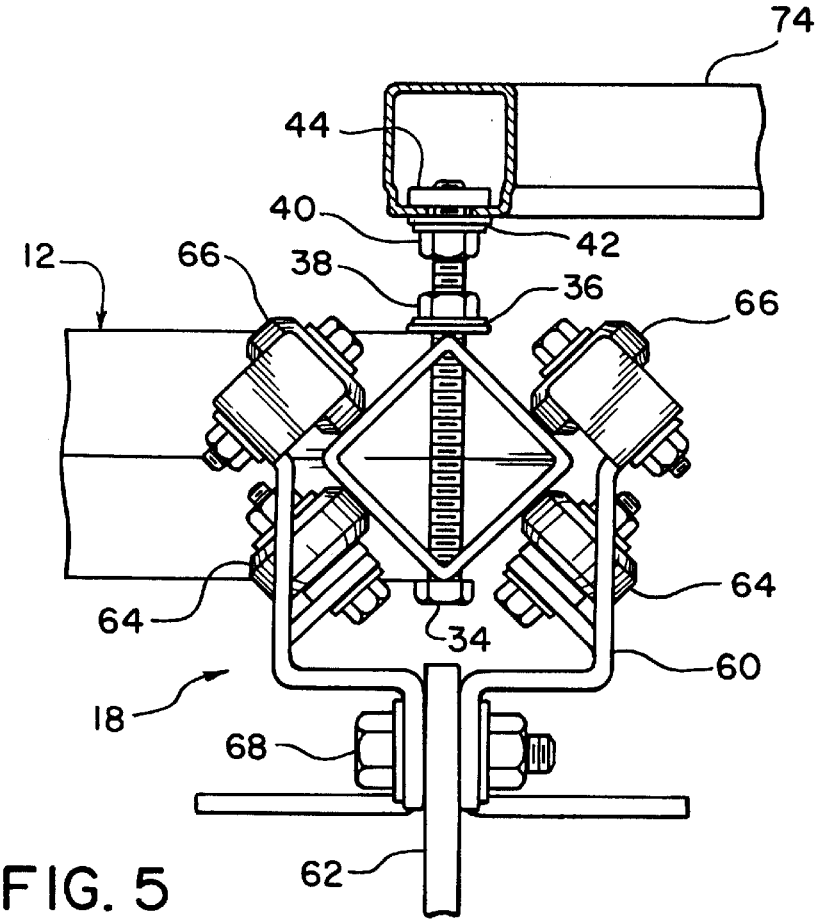
FIG. 5 is a partial cross-sectional view of the curved tool rail and one of the support members taken along section lines 5—5 of FIG. 1 to illustrate the connection between the tool trolley and the curved tool rail.
Figure 6:
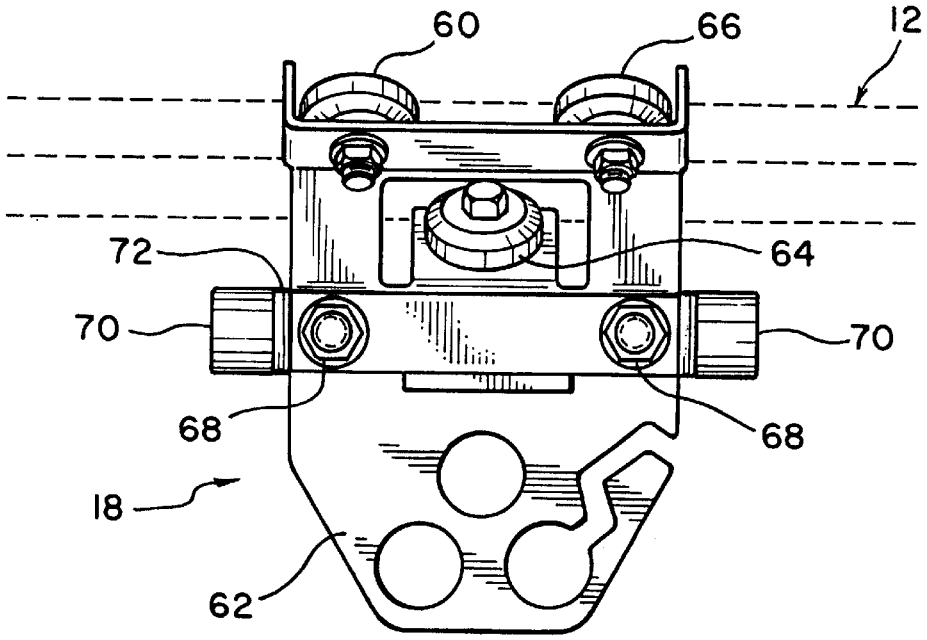
FIG. 6 is a front elevational view of the tool trolley illustrated in FIGS. 1–5, with the curved tool rail shown in broken lines.

Referring to FIGS. 5 and 6, tool trolley 18 preferably includes a trolley frame 60, a tool hook 62 secured to the lower end of trolley frame 60, two stabilizer wheels 64 rotatably coupled to trolley frame 60 and four load supporting wheels 66 also rotatably coupled to trolley frame 60. More specifically, trolley frame 60 is constructed of two substantially identical halves which are preferably constructed of a hard rigid metallic material. More specifically, each of the halves of trolley frame 60 is preferably formed from sheet material which is stamped and bent to the shape shown in FIGS. 3, 5 and 6. The bottom ends of the halves of trolley frame 60 are bolted together via fasteners 68 with tool hook 62 sandwiched therebetween.

Stabilizer wheels 64 and load supporting wheels 66 are preferably steel rollers which are rotatably fastened to trolley frame 60 in a conventional manner. Stabilizer wheels 64 engage the bottom two sides of curved tool rail 12 for sliding along curved tool rail 12. Load supporting wheels 66, on the other hand, engage the two upper sides of curved tool rail 12 for sliding therealong.

Preferably, a pair of rubber bumpers 70 are coupled to trolley frame 60 such that bumpers 70 engage stops 28 to limit the movement of tool trolley 18 along curved tool rail 12. Preferably, bumpers 70 are supported on a metal attachment member 72 which is sandwiched between the halves of trolley frame 60 and secured thereto via fastener 68.

Figure 4:
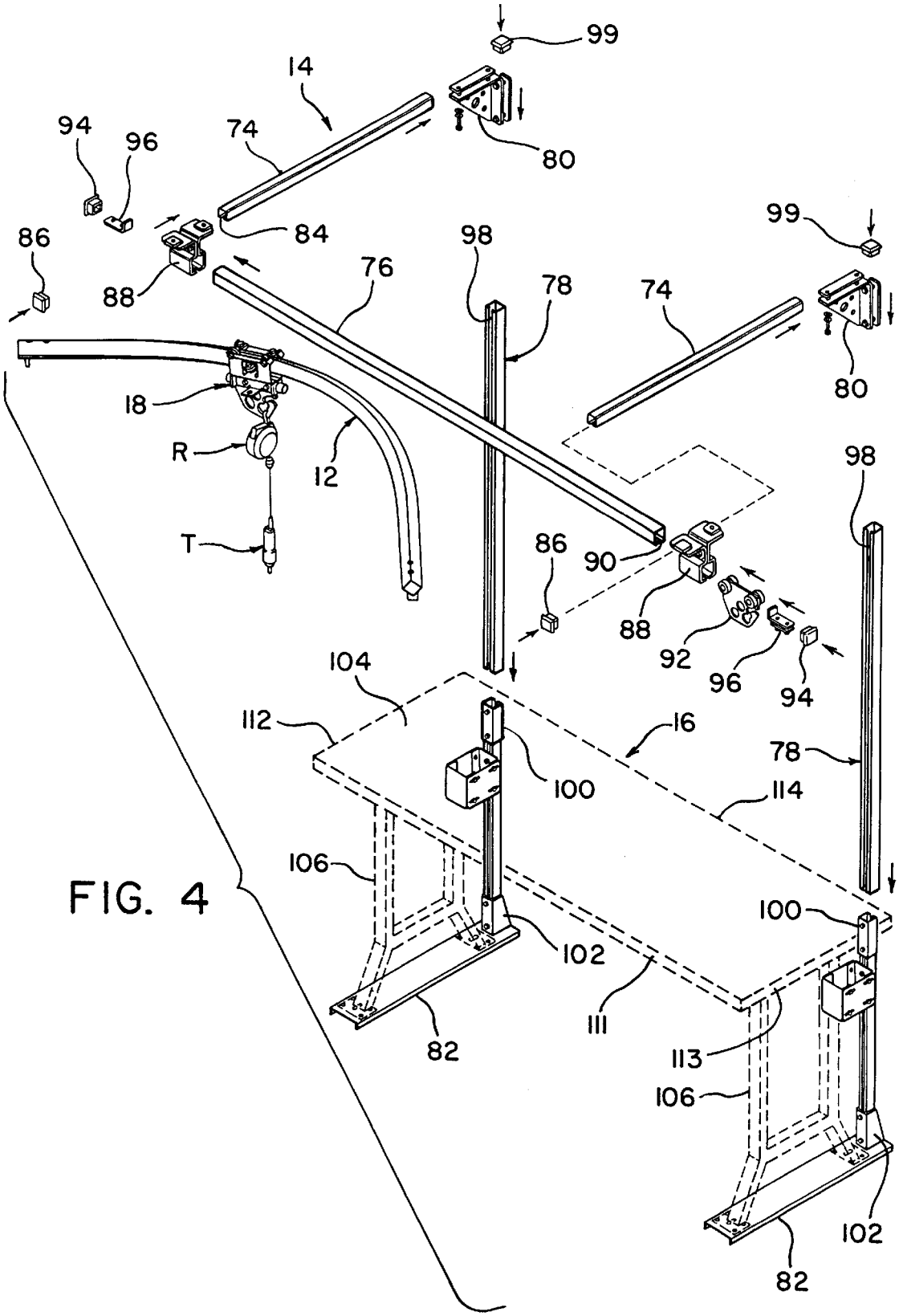
FIG. 4 is an exploded perspective view of the tool support assembly and curved tool rail of the ergonomic workstation illustrated in FIGS. 1–3, with the work bench being illustrated in broken lines for purposes of illustration.

As best seen in FIG. 4, tool support frame 14 preferably includes a pair of horizontal support members or channels 74 for supporting curved tool rail 12 therefrom, a straight tool rail 76 adjustably coupled to the free ends support members 74, a pair of vertical columns 78 adjustably supporting support members 74 via a pair of angle brackets 80, respectively, and a pair of bench leg bases 82 attached to the lower ends of columns 78.

Support members 74 are preferably tubular channels having a substantially rectangular cross-section with a longitudinally extending slot 84 formed in the lower surface of each of the support members 74 for attaching curved tool rail 12 and straight tool rail 76 thereto. In particular, each of the support members 74 has one of the nut plates 44 slidably located within its channel with the threaded end of bolts 34 extending through the slots 84 in the support members 74. Accordingly, curved tool rail 12 is adjustably coupled to support members 74 such that curved tool rails 12 can be moved longitudinally along support members 74. This allows the curved tool rail 12 to be adjusted either closer or farther away from the worker as needed and/or desired by the worker. Of course, by tightening the second nuts 40, the worker can secure curved tool rail 12 at a particular location so that it does not move along support channels 74 until nuts 40 are loosened.

The free ends of support members 74 have end caps 86 located in their open ends for closing off the ends of the support member 74. The other ends of support members 74 are secured to angle brackets 80, which in turn, are adjustably coupled to the upper ends of columns 78. It will be apparent to those skilled in the art from this disclosure that support members 74 can be vertically adjusted by changing the locations at which angle brackets 80 are attached to columns 78. Angle brackets 80 are relatively conventional angle brackets having a web portion for additional support. Angle brackets 80 are coupled to the ends of support members 74 and columns 78 via conventional fasteners and universal nut plates in a manner similar to the attachment of curved tool rail 12 to support members 74. Thus, the particular attachment of angle bracket 80 to support member 74 and columns 78 will not be discussed or illustrated in detail herein.

Straight tool rail 76 is also adjustably coupled to support members 74 via a pair of end hangers 88. Hangers 88 have an open channel for receiving the ends of straight tool rail 76, and are then fastened to support members 74 in a substantially similar manner as curved tool rail 12. Accordingly, straight tool rail 76 is adjustably coupled to support members 74 for movement along the longitudinal length of support members 74. Preferably, straight tool rail 76 is a rectangular channel-shaped member of substantially identical construction to support members 74 and includes a longitudinally extending slot 90 in its lower surface such that a tool trolley 92 is slidably mounted within the channel of straight tool rail 76 with a lower hook portion extending through slot 90 of straight tool rail 76. Straight tool rail 76 is also provided with a pair of end caps 94 for closing off the open ends of straight tool rails 76 and a pair of stops 96 for limiting the movement of tool trolley 92 along straight tool rail 76.

As best seen in FIG. 4, columns 78 are preferably rectangular channels with similar constructions to support members 74 and straight tool rail 76. In other words, columns 78 are substantially rectangular channels having a longitudinally extending slot 98 along one of its sides such that angle brackets 80 can be attached anywhere along the length of columns 78. Accordingly, this allows for vertical adjustment of curved tool rail 12.

While columns 78 are illustrated as being constructed of two sections of rectangular channels which are coupled together by a rail coupler 100, it will be apparent to those skilled in the art from this disclosure that columns 78 can be constructed of a single channel if needed and/or desired.

The upper ends of columns 78 have end caps 99 frictionally secured thereto for closing off their open upper ends. The lower ends of columns 78 are releasably coupled to leg bases 82 in a conventional manner. Leg bases 82 are preferably inverted U-shaped metal plates which rest on the floor such that bench 16 can be bolted thereto. Each of the leg bases 82 are provided with a column support 102 for vertically securing one of the columns 78 thereto. Of course, it will be apparent to those skilled in the art from this disclosure that leg bases 82 could be eliminated if needed and/or desired. For example, columns 78 can be attached to bench 16 as illustrated in FIG. 7, or could be attached to a wall.

Bench 16 is preferably a conventional bench having a table top or work surface 104 with a pair of support legs 106 attached to the under surface of table top 104 for supporting table top 104 at a predetermined height above the floor. Preferably, the bottom ends of support legs 106 are preferably bolted to leg bases 82 as mentioned above. Of course, it will be apparent to those skilled in the art from this disclosure that bench 16 could be free standing or mounted directly to the floor beneath curved tool rail 12. Preferably, table top 104 is substantially rectangular and has a front edge 111, a pair of side edges 112 and 113 and a rear edge 114. Of course, table top 104 can have a variety of shapes. For example, the front edge of table top 104 could be curved if needed and/or desired.

Second Embodiment

Figure 7:
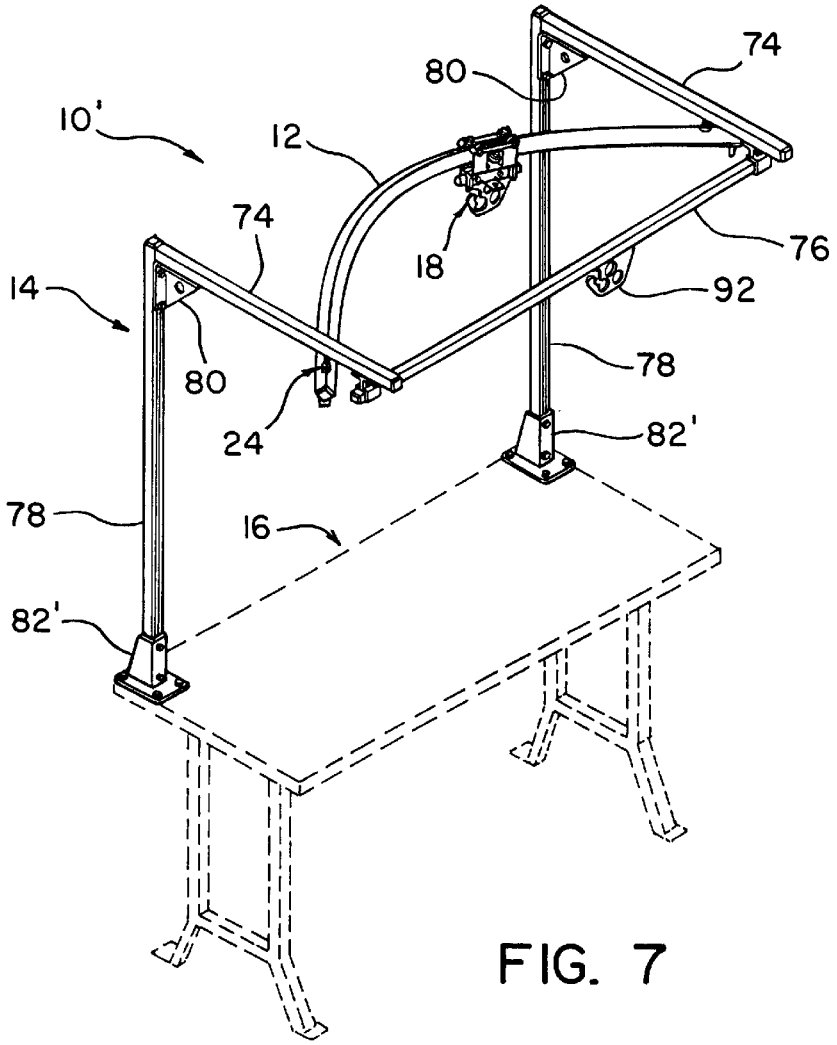
FIG. 7 is a perspective view of a tool support assembly having a tool support frame with a curved tool rail coupled thereto, and which is adapted to be coupled to the top of a work surface or bench (shown in broken lines) in accordance with a second embodiment of the present invention.

Referring now to FIG. 7, a workstation 10' in accordance with a second embodiment of the present invention is illustrated. Workstation 10' is a modified version of workstation 10 which is discussed above. Thus, the parts of workstation 10' which are identical to parts of workstation 10 will be given the same reference numerals. Workstation 10' has the upper part tool support frame 14 attached directly to the top surface 104 of bench 16. In other words, the upper part of tool support frame 14 together with curved tool rail 12 can be sold as a kit which can be attached to almost any type of bench or work surface.

Basically, the only difference between workstation 10' of the second embodiment and workstation 10 of the first embodiment is that the leg bases 82 and the lower parts of columns 78 have been eliminated and replaced with table top brackets 82'. Thus, the upper halves of columns 78 are attached directly to work surface 104 via brackets 82' which are bolted directly to the top of a bench or work surface 104. In view of the similarities of workstation 10' and workstation 10, workstation 10' will not be discussed or illustrated in detail herein.

Third Embodiment

Figure 8:
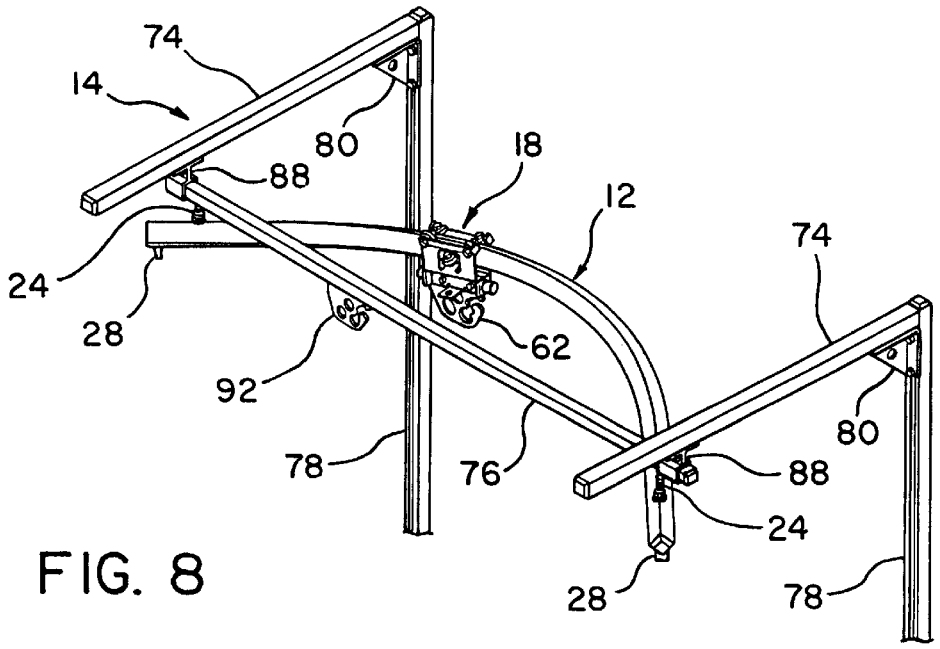
FIG. 8 is a partial perspective view of a portion of a tool support assembly having a tool support frame with a curved tool rail coupled to a straight tool rail in accordance with a third embodiment of the present invention.

Referring now to FIG. 8, a slightly modified version of tool support frame 14 is illustrated in accordance with a third embodiment of the present invention. This embodiment is similar to the first and second embodiments discussed above, except that curved tool rail 12 is mounted to straight tool rail 76 rather than to channel support members 74. The benefit of this design is that curved tool rail 12 can be adjusted side to side along straight tool bar 76. Otherwise, tool support frame 14 can be mounted either to a bench top as illustrated in FIG. 7 or could be attached to the bottom of a bench as illustrated in the first embodiment of FIGS. 1–5.

In any event, it will be apparent to those skilled in the art that there are numerous variations of the subject invention. For example, the tool support frames of the present invention could be utilized in a conveyor line such that the work surface or bench below the curved tool rail is a conveyor. Also, it will be apparent to those skilled in the art that the tool support frame 14 could be attached directly to the building, i.e., the floor, the wall or the ceiling.

Referring now to FIG. 9, a plurality of workstations 210 in accordance with the present invention could be arranged and interconnected such that the curved tool rails 12 of each of the workstations 210 are coupled together by straight intermediate rails 11 such that tools can be transferred between workstations 210. Curved tool rails 12 of the workstations 210 can be suspended above benches 16 in any one of the ways discussed above, or attached to other types of supports.

While several embodiments have been chosen to illustrate the present invention, it will be understood by those skilled in the art from this disclosure that various changes and modifications can be made herein without departing from the scope of the present invention as defined in the appended claims.

What is claimed is:

1. An ergonomic workstation, comprising:

a work surface with an upper surface for working thereon, a lower surface and a front edge which is accessible to a worker, a first support coupled to said work surface to maintain said work surface at a predetermined height;

a curved tool rail having a first end and a second end with a tool trolley movably coupled thereto for movement along said curved tool rail between said first and second ends; and a second support coupled to said curved tool rail and positioned relative to said work surface to suspend said curved tool rail above said work surface.

2. An ergonomic workstation according to claim 1, wherein said curved tool rail has a radius of approximately 2.5 feet to approximately 3.5 feet.

3. An ergonomic workstation according to claim 1, wherein said curved tool rail has a radius of approximately 3.0 feet.

4. An ergonomic workstation according to claim 1, wherein said second support is fixedly coupled to said first support.

5. An ergonomic workstation according to claim 1, wherein said second support is fixedly coupled to said work surface.

6. An ergonomic workstation according to claim 1, wherein said second support has a straight tool rail coupled thereto.

7. An ergonomic workstation according to claim 6, wherein said straight tool rail has a tool trolley slidably coupled thereto.

8. An ergonomic workstation according to claim 6, wherein said curved tool rail is adjustably coupled to straight tool rail for side to side adjustment.

9. An ergonomic workstation according to claim 1, wherein said second support includes a pair of parallel support members with said curved tool rail adjustably coupled thereto.

10. An ergonomic workstation according to claim 9, wherein said second support further includes a pair of vertical columns with said support members adjustably coupled thereto, respectively.

11. An ergonomic workstation according to claim 1, wherein said work surface and said first support member are in the form of a bench.

12. An ergonomic workstation according to claim 11, wherein said upper surface of said work surface is substantially rectangular in plan view.

13. An ergonomic workstation according to claim 12, wherein said upper surface has a rear edge which is spaced from said front edge, said second support being positioned adjacent said rear edge of said upper surface.

14. An ergonomic workstation according to claim 1, wherein said second support includes a pair of horizontal support members coupled to said curved tool rail and a pair of vertical columns coupled to said support members, respectively to suspend said curved tool rail above said work surface; and an attachment member coupled to said columns to vertically support said columns.

15. An ergonomic workstation according to claim 14, wherein said support members are substantially parallel with said curved tool rail adjustably coupled thereto.

16. An ergonomic workstation according to claim 15, wherein said support members are adjustably coupled to said columns for vertical adjustment of said curved tool rail.

17. An ergonomic workstation according to claim 14, wherein each of said support members has a longitudinally extending slot for receiving a fastener to adjustably couple one of said ends of said curved tool rail thereto.

18. An ergonomic workstation assembly according to claim 14, wherein each of said columns has a longitudinally extending slot to adjustably couple said support members thereto via said attachment member.

19. An ergonomic workstation according to claim 18, wherein said attachment member includes a pair of brackets which are fastened within said slots of said columns, respectively.

20. An ergonomic workstation according to claim 19, wherein each of said support members has a longitudinally extending slot for receiving a fastener to adjustably couple one of said ends of said curved tool rail thereto.

21. A tool support assembly for a workstation, comprising:

a curved tool rail having a first end and a second end with a tool trolley movably coupled thereto for movement along said tool rail between said first and second ends;

a frame having a pair of horizontal support members coupled to said curved tool rail and a pair of vertical columns coupled to said support members, respectively to suspend said curved tool rail above a work area; and an attachment member coupled to said columns to vertically support said columns.

22. A tool support assembly according to claim 21, wherein said curved tool rail has a radius of approximately 2.5 feet to approximately 3.5 feet.

23. A tool support assembly according to claim 21, wherein said curved tool rail has a radius of approximately 3.0 feet.

24. A tool support assembly according to claim 21, wherein said support members have a straight tool rail coupled therebetween.

25. A tool support assembly according to claim 24, wherein said straight tool rail has a tool trolley slidably coupled thereto.

26. A tool support assembly according to claim 24, wherein said curved tool rail is adjustably coupled to straight tool rail for side to side adjustment.

27. A tool support assembly according to claim 21, wherein said support members are substantially parallel with said curved tool rail adjustably coupled thereto.

28. A tool support assembly according to claim 27, wherein said support members are adjustably coupled to said columns for vertical adjustment of said curved tool rail.

29. A tool support assembly according to claim 21, wherein each of said support members has a longitudinally extending slot for receiving a fastener to adjustably couple one of said ends of said curved tool rail thereto.

30. A tool support assembly according to claim 21, wherein each of said columns has a longitudinally extending slot to adjustably couple said support members thereto via said attachment member.

31. A tool support assembly according to claim 30, wherein said attachment member includes a pair of brackets which are fastened within said slots of said columns, respectively.

32. A tool support assembly according to claim 31, wherein each of said support members has a longitudinally extending slot for receiving a fastener to adjustably couple one of said ends of said curved tool rail thereto.

* * * * *